US008882295B2

(12) United States Patent
Kimiya et al.

(10) Patent No.: US 8,882,295 B2
(45) Date of Patent: Nov. 11, 2014

(54) LAMP DEVICE AND LUMINAIRE

(75) Inventors: Junichi Kimiya, Yokosuka (JP); Masahiro Toda, Yokosuka (JP)

(73) Assignee: Toshiba Lighting & Technology Corporation, Kanagawa (JP)

( * ) Notice: Subject to any disclaimer, the term of this patent is extended or adjusted under 35 U.S.C. 154(b) by 219 days.

(21) Appl. No.: 13/418,204

(22) Filed: Mar. 12, 2012

(65) Prior Publication Data

US 2012/0250324 A1 Oct. 4, 2012

(30) Foreign Application Priority Data

Mar. 31, 2011 (JP) ..... 2011-079076

(51) Int. Cl.

| | |
|---|---|
| ***F21V 29/00*** | (2006.01) |
| ***F21V 7/04*** | (2006.01) |
| ***F21V 19/00*** | (2006.01) |
| ***F21V 23/00*** | (2006.01) |
| ***F21K 99/00*** | (2010.01) |
| *F21S 2/00* | (2006.01) |
| *F21Y 101/02* | (2006.01) |
| *F21S 8/02* | (2006.01) |
| *F21Y 105/00* | (2006.01) |

(52) U.S. Cl.

CPC ..... *F21V 19/003* (2013.01); *F21V 29/246* (2013.01); *F21S 2/005* (2013.01); *F21V 7/041* (2013.01); *F21V 29/262* (2013.01); *F21V 29/22* (2013.01); *F21Y 2101/02* (2013.01); *F21V 23/009* (2013.01); *F21S 8/026* (2013.01); *F21V 23/006* (2013.01); *F21K 9/30* (2013.01); *F21Y 2105/001* (2013.01)

USPC ..... 362/249.02

(58) Field of Classification Search

CPC ..... F21V 29/00; F21V 29/002; F21V 29/004; F21V 29/008; F21V 29/22; F21V 29/246

See application file for complete search history.

(56) References Cited

U.S. PATENT DOCUMENTS

| | | | | |
|---|---|---|---|---|
| 8,414,178 | B2 * | 4/2013 | Alexander et al. | 362/655 |
| 8,430,535 | B2 * | 4/2013 | Watanabe et al. | 362/294 |
| 8,641,246 | B2 * | 2/2014 | Takahara et al. | 362/373 |
| 2006/0232974 | A1 * | 10/2006 | Lee et al. | 362/294 |
| 2009/0046458 | A1 * | 2/2009 | Lee | 362/235 |
| 2009/0213595 | A1 | 8/2009 | Alexander et al. | |
| 2010/0309671 | A1 * | 12/2010 | Meyer et al. | 362/373 |

FOREIGN PATENT DOCUMENTS

| | | | |
|---|---|---|---|
| CN | 201363575 | Y | 12/2009 |
| CN | 101794762 | A | 8/2010 |
| EP | 2336631 | | 6/2011 |
| JP | 2010-262781 | | 11/2010 |
| WO | 2008/119392 | | 10/2008 |
| WO | 2010/061746 | | 6/2010 |
| WO | 2010/061746 | A1 | 6/2010 |

OTHER PUBLICATIONS

European Search Report dated Nov. 27, 2012, filed in European counterpart Application No. 12158514.5, 3 pages.

China Office Action dated Dec. 26, 2013 for Application No. 201210074927.0.

* cited by examiner

*Primary Examiner* — Bao Q Truong

(74) *Attorney, Agent, or Firm* — Patterson & Sheridan LLP

(57) ABSTRACT

According to one embodiment, a lamp device includes a main body, a light-emitting module, a lighting device and a support member. The main body includes an opening and a heat radiating part provided at an opposite side of the opening. The support member is thermally coupled to the light-emitting module and the heat radiating part. The support member holds the light-emitting module in the main body to cause the light-emitting module to be positioned in a direction closer to the opening than the lighting device.

14 Claims, 6 Drawing Sheets

LAMP DEVICE AND LUMINAIRE

CROSS-REFERENCE TO RELATED APPLICATIONS

This application is based upon and claims the benefit of priority from prior Japanese Patent Application No. 2011-079076, filed Mar. 31, 2011, the entire contents of which are incorporated herein by reference.

FIELD

Embodiments described herein relate generally to a lamp device in which heat generated by a light-emitting element is radiated from a thermal radiating member, and a luminaire using the lamp device.

BACKGROUND

JP-A-2010-262781 discloses a flat lamp device using, for example, a GX53 type base. In this type of lamp device, luminous intensity distribution is controlled so that an opening angle of a beam becomes a middle-angle, and the luminous intensity distribution suitable for, for example, a downlight or a spotlight is obtained.

The lamp device disclosed in the above patent publication includes a lamp main body, an LED module, a reflector, a lighting device and a globe. The lamp main body is integrated with the GX53 type base. The base includes a contact surface provided with a pair of connection terminals, and a cylindrical protrusion protruding from the center of the contact surface. When the lamp device is attached to a socket of a luminaire, the contact surface contacts a lower surface of the socket. When the lamp device is attached to the socket, the protrusion enters the inside of an insertion hole provided in the socket.

The LED module is arranged at the top of the protrusion. The LED module includes a module substrate on which plural LEDs are mounted. The module substrate is supported on an inner surface of the top of the protrusion so that the LEDs are positioned at the center of the lamp device. The module substrate contacts the inner surface of the top, so that the module substrate is thermally connected to the protrusion. By this, heat generated by the LEDs is conducted from the base to the luminaire through the socket, and is radiated from the luminaire to the atmosphere.

The reflector is supported by the lamp main body and is positioned inside the protrusion of the base. The reflector includes a cylindrical light reflecting surface, and the light reflecting surface surrounds the LED module. The lighting device is a component to turn on the LEDs and is electrically connected to the module substrate. The lighting device is housed in a ring-shaped space formed between the lamp main body and the reflector. The globe is supported by the lamp main body and covers the reflector and the LED module.

According to the related art lamp device, the LED module is positioned at the top of the protrusion of the base, and is surrounded by the light reflecting surface of the reflector. The reflector protrudes from the periphery of the LED module to the globe. Thus, part of light emitted by the LEDs is repeatedly reflected by the light reflecting surface, and then is emitted to the globe from an opening end of the reflector.

However, if the reflection is repeated before the light emitted from the LEDs reaches the globe, the attenuation of the light can not be avoided. As a result, the light emitted from the LEDs can not be efficiently extracted to the outside of the lamp device.

DETAILED DESCRIPTION

In general, according to one embodiment, a lamp device includes a cylindrical main body, a light-emitting module, a lighting device and a support member. The main body includes an opening, and a heat radiating part provided at an opposite side to the opening. The light-emitting module, the lighting device and the support member are housed in the main body. The light-emitting module includes a light-emitting element to emit light to the opening. The support member is thermally connected to the light-emitting module and the heat radiating part, and conducts heat generated by the light-emitting element to the heat radiating part. The support member holds the light-emitting module in the main body to cause the light-emitting module to be positioned in a direction closer to the opening than the lighting device.

First Embodiment

Hereinafter, a lamp device of a first embodiment will be described with reference to FIG. 1 to FIG. 4.

Figure 1:
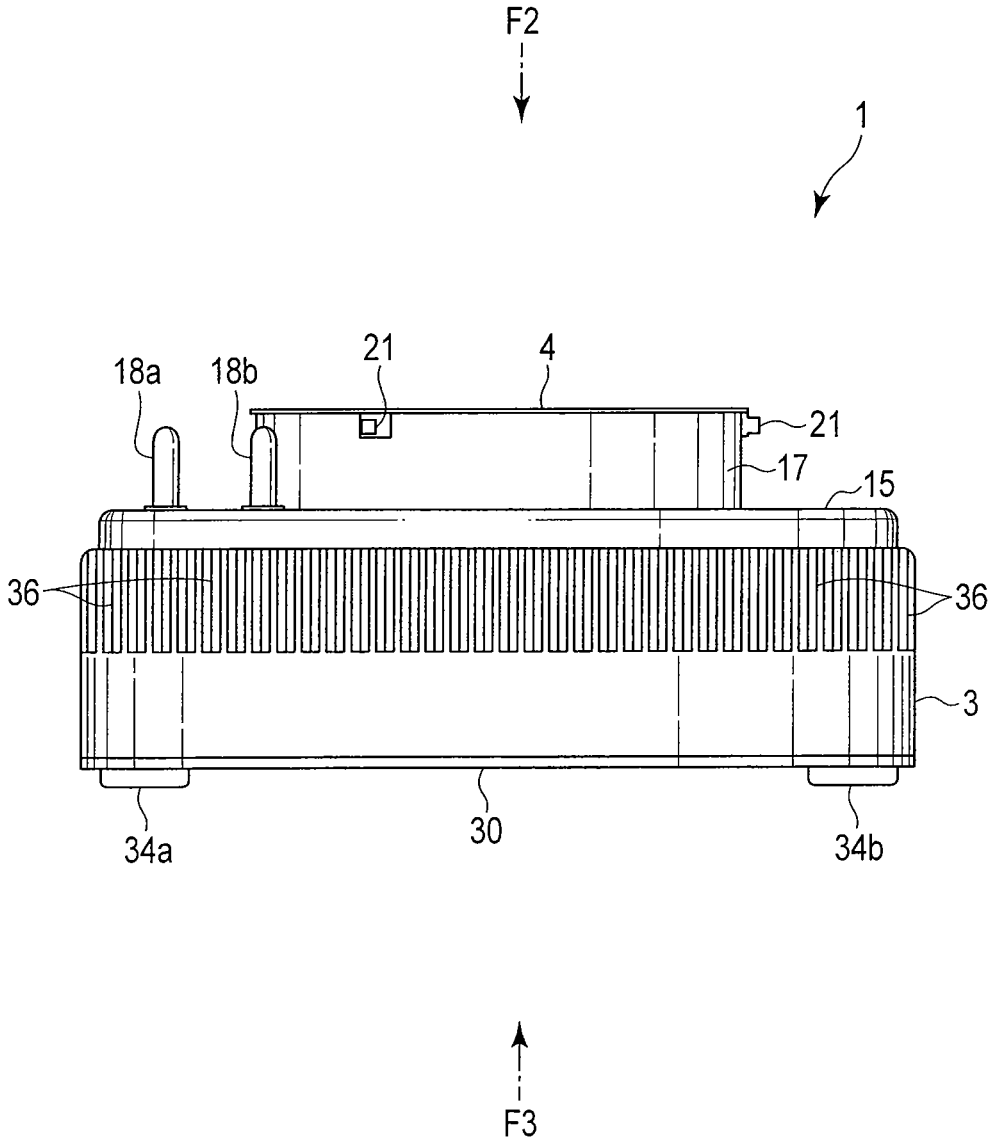
FIG. 1 is an exemplary side view of a lamp device of a first embodiment.

FIG. 1 shows a thin lamp device 1 having luminous intensity distribution suitable for, for example, a downlight or a spotlight. The lamp device 1 includes a light-emitting module 2, a main body 3, a heat radiating member 4, a support member 5 and a lighting device 6.

The light-emitting module 2 includes a module substrate 7, plural light-emitting diodes 8 and a sealing member 9. The module substrate 7 is made of a metal material, such as aluminum, having an excellent heat radiation property. The module substrate 7 is substantially rectangular, and includes a first surface 7*a* and a second surface 7*b*. The first surface 7*a* is covered with an insulating layer. The second surface 7*b* is positioned at the back side of the first surface 7*a*.

The light-emitting diode 8 is an example of a light-emitting element. The light-emitting diode 8 is composed of, for example, a bare chip to emit blue light. The light-emitting diodes 8 are arranged in a matrix form on the insulating layer, and are connected in series through a conductive pattern formed on the insulating layer. A connector 10 is mounted on one end of the first surface 7*a* of the module substrate 7. The connector 10 is electrically connected to the conductive pattern.

Figure 4:
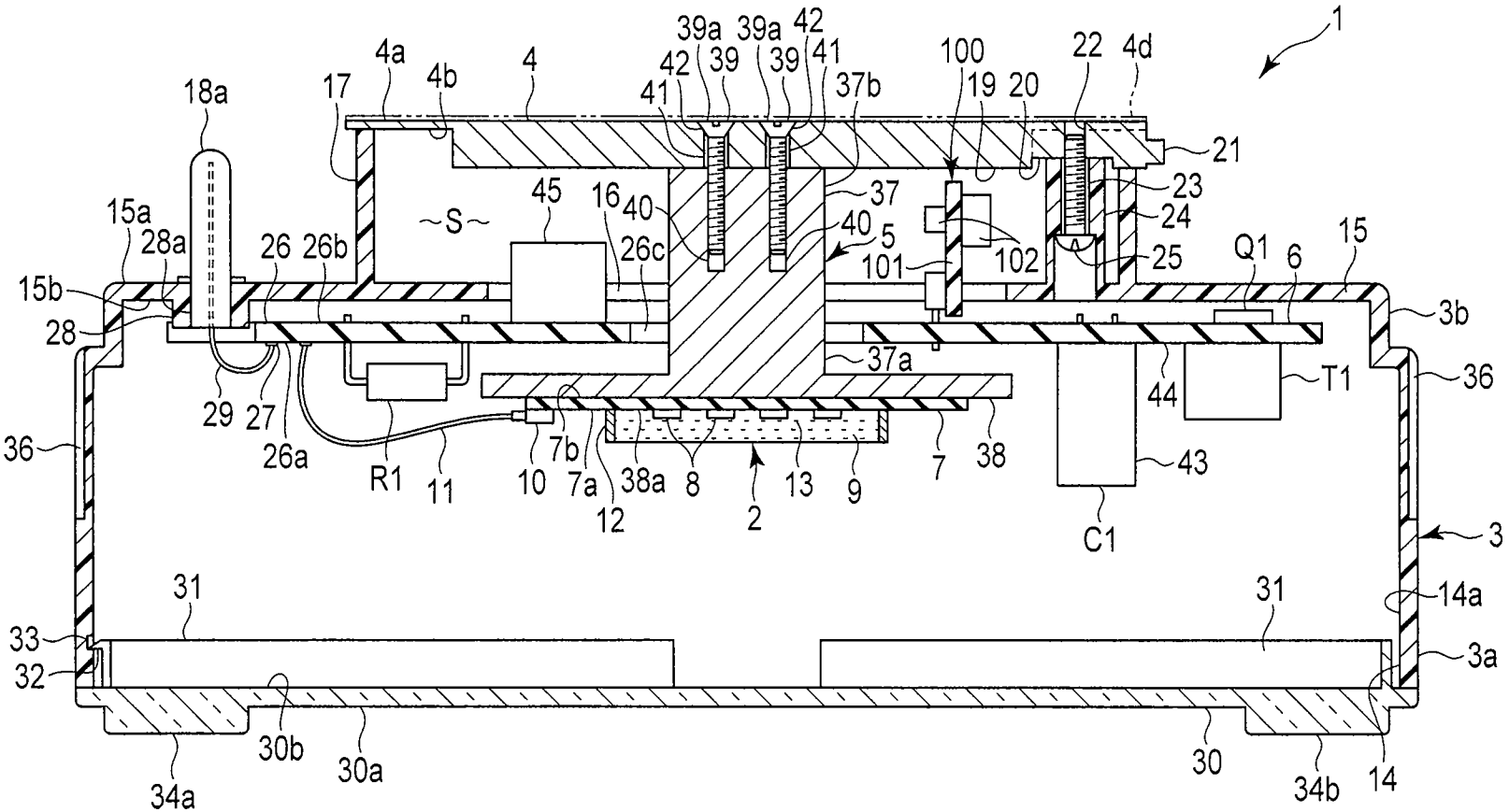
FIG. 4 is an exemplary sectional view of the lamp device of the first embodiment.

As shown in FIG. 4, a foursided frame 12 is fixed to the first surface 7*a* of the module substrate 7. The frame 12 is made of a synthetic resin material such as silicone resin. The frame 12 surrounds the light-emitting diodes 8.

The sealing member 9 is made of a translucent resin material such as transparent silicone resin. The sealing member 9 is filled in a region surrounded by the frame 12 and covers the light-emitting diodes 8. A surface of the sealing member 9 is flat.

A yellow phosphor 13 is mixed in the sealing member 9. When blue light emitted by each light-emitting diode 8 is incident on the yellow phosphor 13, the yellow phosphor 13 is excited by the blue light and emits yellow light. The yellow light and the blue light are mixed with each other in the inside of the sealing member 9, and become white light. The white light is emitted from the surface of the sealing member 9 to the outside of the light-emitting module 2. Thus, the surface of the sealing member 9 functions as a light-emitting surface to emit the white light.

As shown in FIG. 4, the light-emitting module 2 is housed in the main body 3. The main body 3 is made of a synthetic resin material such as polybutylene terephthalate. The main body 3 has a cylindrical shape including a first end 3*a* and a second end 3*b*. The first end 3*a* defines a circular opening 14. A flat end wall 15 is formed integrally with the second end 3*b*. The end wall 15 includes a flat upper surface 15*a* and a lower surface 15*b*. A circular through hole 16 is formed in the center of the end wall 15. The through hole 16 is an example of a through part, and is opened in the upper surface 15*a* and the lower surface 15*b*. Further, plural concave parts 36 are formed in an outer peripheral surface of the main body 3. The concave parts 36 extend in the axial direction of the main body 3 and are arranged at intervals in the circumferential direction of the main body 3.

Figure 2:
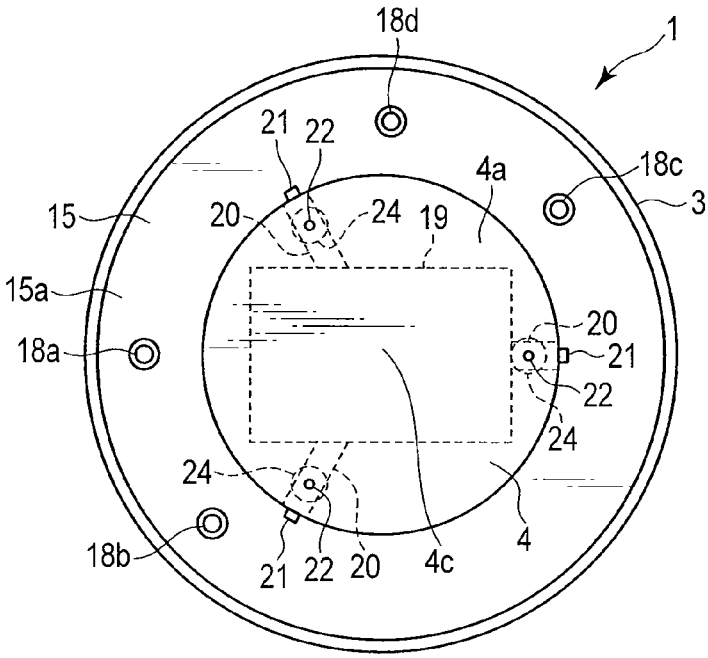
FIG. 2 is an exemplary plan view of the lamp device when viewed from a direction of an arrow F2 of FIG. 1.

A cylindrical protrusion 17 is formed on the upper surface 15*a* of the end wall 15. The protrusion 17 concentrically surrounds the through hole 16, and protrudes from the end wall 15 to the opposite side of the opening 14. As shown in FIG. 2, a pair of power supply pins 18*a* and 18*b* and a pair of lighting control pins 18*c* and 18*d* are arranged on the upper surface 15*a* of the end wall 15. The power supply pins 18*a* and 18*b* and the lighting control pins 18*c* and 18*d* are made of, for example, brass. The power supply pins 18*a* and 18*b* and the lighting control pins 18*c* and 18*d* are substantially cylindrical, and each tip is formed into a hemispherical shape. The power supply pins 18*a* and 18*b* and the lighting control pins 18*c* and 18*d* are arranged outside the protrusion 17 and at intervals in the circumferential direction of the protrusion 17. Further, the power supply pins 18*a* and 18*b* and the lighting control pins 18*c* and 18*d* protrude from the end wall 15 to the opposite side of the opening 14.

The heat radiating member 4 is an example of a heat radiating part. As shown in FIG. 1 and FIG. 4, the heat radiating member 4 is attached to a tip of the protrusion 17. The heat radiating member 4 is, for example, a die-cast part using aluminum. The heat radiating member 4 closes an opening end of the protrusion 17 so as to face the through hole 16 of the end wall 15. In other words, the heat radiating member 4 is spaced from the end wall 15 of the main body 3 by a distance corresponding to the height of the protrusion 17. Thus, the heat radiating member 4 is exposed to the outside of the main body 1 at the opposite side of the opening 14.

The heat radiating member 4 has a disk shape including an upper surface 4*a* and a lower surface 4*b*. The upper surface 4*a* of the heat radiating member 4 is covered with a heat radiating sheet 4*d*. The lower surface 4*b* of the heat radiating member 4 is exposed to the inside of the protrusion 17 so as to face the through hole 16. A foursided heat receiving part 19 is formed at the center of the heat radiating member 4. The heat receiving part 19 protrudes from the lower surface 4*b* of the heat radiating member 4 to the through hole 16.

As shown in FIG. 2, three fixing parts 20 are formed on the lower surface 4*b* of the heat radiating member 4. The fixing parts 20 protrude from the lower surface 4*b* of the heat radiating member 4 and radially extend from the heat receiving part 19 to an outer peripheral edge of the heat radiating member 4. In the first embodiment, the fixing parts 20 are arranged at intervals of 120° in the circumferential direction of the heat radiating member 4 with respect to a center 4*c* of the heat radiating member 4. Tips of the fixing parts 20 are continuous with an outer peripheral surface of the heat radiating member 4.

Further, each of the fixing parts 20 includes an engagement part 21 and a screw hole 22. Each engagement part 21 is positioned at the tip of the fixing part 20. The engagement part 21 protrudes to the outside along the radial direction of the heat radiating member 4 from the outer peripheral surface of the heat radiating member 4. Each screw hole 22 includes an opening end opened in the upper surface 4*a* of the heat radiating member 4. The opening end of the screw hole 22 is closed by the heat radiating sheet 4*d*.

As shown in FIG. 2 and FIG. 4, three boss parts 24 are formed on the end wall 15 of the main body 3. The boss parts 24 protrude from the upper surface 15*a* of the end wall 15 to the fixing parts 20 of the heat radiating member 4. Tips of the boss parts 24 contact the fixing parts 20. Each of the boss parts 24 includes a through hole 23. Each through hole 23 passes through the boss part 24 so as to coincide with the screw hole 22 of the fixing part 20.

A screw 25 is inserted in the through hole 23 of the boss part 24. The screw 25 is inserted into the through hole 23 from the direction of the lower surface 15*b* of the end wall 15, and is screwed in the screw hole 22 of the heat radiating member 4. By this, the fixing parts 20 of the heat radiating member 4 are tightened to the tips of the boss parts 24, and the heat radiating member 4 is coaxially fixed to the opening end of the protrusion 17. In the state where the heat radiating member 4 is fixed to the protrusion 17, an outer peripheral part of the heat radiating member 4 slightly protrudes from an outer peripheral surface of the protrusion 17 to the outside along the radial direction of the protrusion 17. The opening end of the protrusion 17 is partially cut away to avoid the fixing parts 20 of the heat radiating member 4.

Further, the engagement parts 21 of the heat radiating member 4 are inserted in plural key grooves provided in a luminaire to which the lamp device 1 is attached. The end wall 15 of the main body 3, the protrusion 17, the power supply pins 18*a* and 18*b*, the lighting control pins 18*c* and 18*d* and the heat radiating member 4 cooperate with each other to constitute a base.

As shown in FIG. 4, the lighting device 6 includes a disk-shaped circuit board 26 and plural circuit parts 43. The circuit board 26 is formed of, for example, a glass epoxy member. The circuit board 26 includes a first mount surface 26*a*, a second mount surface 26*b* positioned at the backside of the first mount surface 26*a*, and a circular center hole 26*c*. The center hole 26*c* is opened at the center of the circuit board 26 and in the first mount surface 26*a* and the second mount surface 26*b*.

The circuit parts 43 include various electronic parts such as a resistor R1, a capacitor C1 and a transformer T1 and a surface mount device 45, for example, a switching element Q1. In the first embodiment, the electronic parts such as the resistor R1, the capacitor C1 and the transformer T1 are mounted on the first mount surface 26*a* of the circuit board 26. The surface mount device 45 such as the switching element Q1 is mounted on the second mount surface 26*b* of the circuit board 26. In other words, the circuit parts 43 are dispersed and arranged on the first mount surface 26*a* and the second mount surface 26*b* of the circuit board 26 so as to surround the center hole 26*c* of the circuit board 26.

The circuit parts 43 are electrically connected through conductor patterns formed on the circuit board 26, and constitute a lighting circuit 44. The light circuit 44 is a component to turn on the light-emitting diodes 8 of the light-emitting module 2, and a well-known circuit system can be adopted. The lighting circuit 44 is electrically connected to the connector 10 of the light-emitting module 2 through an output code 11. The lighting circuit 44 supplies constant current to the light-emitting diodes 8 of the light-emitting module 2.

The lighting device 6 is housed in the main body 3. The circuit board 26 of the lighting device 6 is supported by the end wall 15 of the main body 3, and is separated from the opening 14 of the main body 3. The movement of the circuit board 26 in the circumferential direction, the axial direction and the radial direction of the main body 3 is restricted by a regulating unit. The circuit board 26 may be divided into plural plates.

According to the first embodiment, the circuit board 26 is arranged in parallel to the end wall 15, and the second mount surface 26*b* faces the lower surface 15*b* of the end wall 15 and the through hole 16. Thus, the switching element Q1 is housed in a gap between the circuit board 26 and the end wall 15. A tall surface mount device 45 passes through the through hole 16 and enters a space S formed between the circuit board 26 and the heat radiating member 4. The space S is surrounded by the protrusion 17.

A pair of power supply input terminals 27 (only one is shown) are arranged on the second mount surface 26*b* of the circuit board 26. The power supply input terminals 27 are positioned in the vicinities of the power supply pins 18*a* and 18*b* in the main body 3. As shown in FIG. 4, a pair of pin support parts 28 (only one is shown) are formed on the end wall 15 of the main body 3. The pin support parts 28 protrude from the lower surface 15*b* of the end wall 15 to the inside of the main body 3. The pin support parts 28 include fitting holes 28*a* for supporting the power supply pins 18*a* and 18*b*. Roots of the power supply pins 18*a* and 18*b* are press-inserted into the fitting holes 28*a*, and the power supply pins are fixed to the end wall 15. The power supply pins 18*a* and 18*b* are respectively electrically connected to the power supply input terminals 27 of the circuit board 26 through lead wires 29. The lead wires 29 are inserted from the roots of the power supply pins 18*a* and 18*b* to the inside of the power supply pins 18*a* and 18*b*, and are soldered to inner surfaces of tips of the power supply pins 18*a* and 18*b*.

As shown in FIG. 4, the lighting device 6 includes a lighting control unit 100. The lighting control unit 100 is a component to adjust the brightness of light emitted by, for example, the light-emitting diodes 8. The lighting control unit 100 includes a foursided lighting control substrate 101 and plural electronic parts 102 mounted on the lighting control substrate 101. The lighting control unit 100 is housed inside the protrusion 17 of the main body 3.

According to the first embodiment, the lighting control substrate 101 of the lighting control unit 100 is erected along the axial direction of the protrusion 17 so as to be orthogonal to the circuit board 26 of the lighting device 6. Further, one end of the lighting control substrate 101 passes through the through hole 16 of the end wall 15 and is adjacent to the second mount surface 26*b* of the circuit board 26. Thus, in the first embodiment, the lighting control unit 100 is housed in the space S between the circuit board 26 and the heat radiating member 4.

The support member 5 is an example of a support part. The support member 5 is made of a metal material, such as aluminum, having excellent heat conductivity. The support member 5 includes a leg part 37 and an LED attachment part 38. The leg part 37 is cylindrical, and has such an outer diameter that the leg part can pass through the through hole 16 of the end wall 15 and the center hole 26*c* of the circuit board 26. The leg part 37 includes a first end 37*a* and a second end 37*b*. The first end 37*a* and the second end 37*b* are separated from each other in the axial direction of the leg part 37. The whole length of the leg part 37 is longer than the whole length of the protrusion 17.

The LED attachment part 38 is formed integrally with the first end 37*a* of the leg part 37. The LED attachment part 38 has a flat plate shape, and extends like a flange from the first end 37*a* of the leg part 37. The LED attachment part 38 has a shape larger than the light-emitting module 2, the through hole 16 of the end wall 15 and the center hole 26*c* of the circuit board 26. Further, the LED attachment part 38 includes a heat receiving surface 38*a*. The heat receiving surface 38*a* is positioned at the opposite side of the leg part 37.

The module substrate 7 of the light-emitting module 2 is fixed to the center of the heat receiving surface 38*a* of the LED attachment part 38 by plural screws. By this, the light-emitting diodes 8 of the light-emitting module 2 face the opening 14 at positions shifted in the direction toward the opening 14 from the end wall 15 of the main body 3. Further, the second surface 7*b* of the module substrate 7 is thermally connected to the heat receiving surface 38*a*.

As shown in FIG. 4, the leg part 37 of the support member 5 is inserted in the center hole 26*c* of the circuit board 26 from the direction of the opening 14 of the main body 3. The second end 37*b* of the leg part 37 is fixed to the center of the heat receiving part 19 by plural screws 39.

Specifically, plural screw holes 40 are formed in an end face of the second end 37*b* of the leg part 37. The screw holes 40 coincide with plural through holes 41 opened in the heat receiving part 19. The screws 39 are an example of a fixing unit, and are screwed in the screw holes 40 through the through holes 41. By this, the end face of the second end 37*b* of the leg part 37 is pressed to the center of the heat receiving part 19, and the leg part 37 is coupled to the heat radiating member 4. Accordingly, the support member 5 is thermally connected to the heat receiving part 19.

In the state where the support member 5 is fixed to the heat radiating member 4, the first end 37*a* of the leg part 37 including the LED attachment part 38 protrudes to the inside of the main body 3 than the first mount surface 26*a* of the circuit board 26. Thus, the LED attachment part 38 protrudes in the direction toward the opening 14 of the main body 3 than the end wall 15 of the main body 3. Further, a portion of the LED attachment part 38 protruding at the periphery of the leg part 37 faces the first mount surface 26*a* of the circuit board 26. In other words, the circuit board 26 is interposed between the end wall 15 of the main body 3 and the LED attachment part 38 of the support member 5. As a result, an inner peripheral portion of the circuit board 26 to define the center hole 26*c* is kept in such a positional relation as to overlap the LED attachment part 38.

Plural spot facing portions 42 are formed in the upper surface 4*a* of the heat radiating member 4. The spot facing portions 42 are positioned at opening ends of the through holes 41. A head 39*a* of each of the screws 39 is housed in the spot facing portion 42 so that the head does not protrude from the upper surface 4*a* of the heat radiating member 4. By the existence of the spot facing portions 42, the heat radiating sheet 4*d* covering the upper surface 4*a* of the heat radiating member 4 can be prevented from rising from the heat radiating member 4.

As most clearly shown in FIG. 4, the support member 5 supports the light-emitting module 2 so that the light-emitting module 2 is positioned at the inside of the main body 3 separate from the heat radiating member 4 and heat can be conducted to the heat radiating member 4. As a result, the light-emitting module 2 is housed inside the main body 3 and the light emitted by the light-emitting diodes 8 is radiated from the opening 14 of the main body 3.

The opening 14 of the main body 3 is covered with a disk-shaped protecting cover 30. The protecting cover 30 is formed of a translucent resin material such as polycarbonate. The protecting cover 30 includes a flat outer surface 30*a* and an inner surface 30*b*. The outer surface 30*a* is exposed to the outside of the lamp device 1 from the first end 3*a* of the main body 3. The inner surface 30*b* faces the opening 14 of the main body 3.

Plural protrusions 31 are formed integrally with the inner surface 30*b* of the protecting cover 30. The protrusions 31 are curved into arc shapes along the inner surface 14*a* of the opening 14, and are arranged at intervals in the circumferential direction of the main body 3. Some protrusions 31 of the protrusions 31 include latch pawls 32. The latch pawls 32 are hooked in latch grooves 33 formed in the inner surface 14*a* of the opening 14. By this, the protecting cover 30 is supported by the main body 3 so as to substantially hermetically seal the inside of the main body 3.

Figure 3:
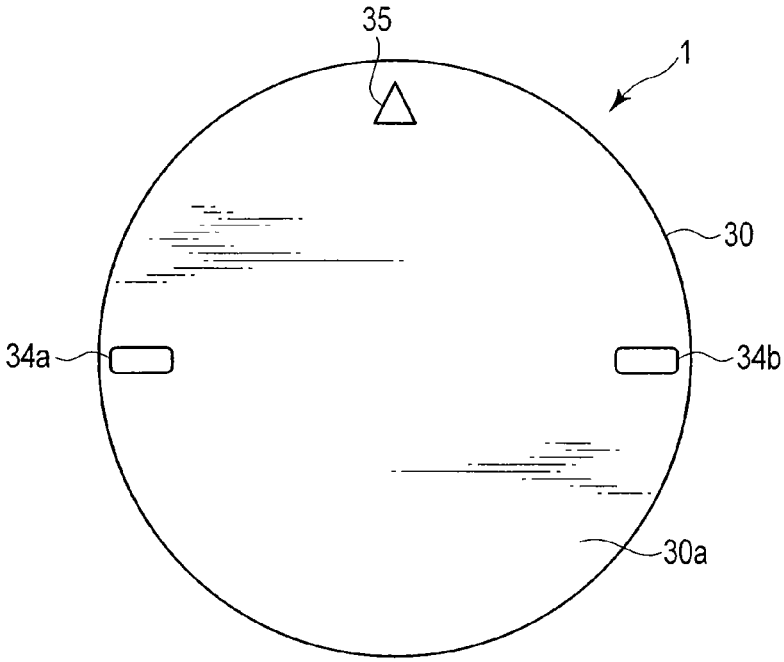
FIG. 3 is an exemplary plan view of the lamp device when viewed from a direction of an arrow F3 of FIG. 1.

As shown in FIG. 3 and FIG. 4, a pair of finger hook parts 34*a* and 34*b* and a triangular mark 35 are formed on an outer peripheral part of the outer surface 30*a* of the protecting cover 30. The finger hook parts 34*a* and 34*b* slightly protrude from the outer peripheral part of the outer surface 30*a* at positions separated from each other by 180° in the circumferential direction of the protecting cover 30. The triangular mark 35 is a component to indicate the direction of the lamp device 1 with respect to the luminaire when the lamp device 1 is attached to the luminaire.

In the state where the lamp device 1 is attached to the luminaire, the protrusion 17 of the main body 3 is inserted in a socket of the luminaire. The power supply pins 18*a* and 18*b* and the lighting control pins 18*c* and 18*d* protruding from the main body 3 are inserted in plural connection holes of the socket. Further, the power supply pins 18*a* and 18*b* are electrically connected to a pair of power supply terminals provided in the socket by rotating the main body 3 in the circumferential direction. Similarly, the lighting control pins 18*c* and 18*d* are electrically connected to a pair of lighting control terminals provided in the socket by rotating the main body 3 in the circumferential direction. By this, AC voltage is applied to the lighting device 6 of the lamp device 1 through the base from an external power supply.

When the protrusion 17 of the main body 3 is inserted in the socket, the triangular mark 35 of the protecting cover 30 is made to coincide with a guide mark formed on the luminaire or the socket. In the state where the triangular mark 35 coincides with the guide mark, the engagement parts 21 of the heat radiating member 4 are inserted in grooves provided in the socket. The engagement parts 21 are detachably hooked in the grooves by rotating the main body 3 in the circumferential direction. As a result, the lamp device 1 is held by the luminaire, and the heat radiating member 4 fixed to the main body 3 contacts a luminaire main body of the luminaire through the heat radiating sheet 4*d*.

When the external power supply is turned on, AC voltage is applied to the lighting device 6 of the lamp device 1 from the power supply pins 18*a* and 18*b* and the lighting control pins 18*c* and 18*d*, and the lighting circuit 44 of the lamp device 6 operates. The lighting circuit 44 supplies constant current to the light-emitting module 2 through the output code 11. By this, the light-emitting diodes 8 simultaneously emit light, and white light is emitted from the light-emitting module 2 to the protecting cover 30. The white light passes through the protecting cover 30 and is used for illumination.

In the first embodiment, the light-emitting module 2 is housed inside the main body 3 so that the light-emitting module is separated from the end wall 15 of the main body 3 in the direction toward the opening 14. By this, a distance between the light-emitting module 2 and the protecting cover 30 is shorter than a distance between the end wall 15 and the protecting cover 30. Further, the circuit board 26 of the lighting device 6 is disposed between the light-emitting module 2 and the end wall 15 of the main body 3. Thus, the light directed to the protecting cover 30 from the light-emitting module 2 is not blocked by the circuit parts 43 mounted on the circuit board 26.

As a result, loss of the light emitted from the light-emitting module 2 is suppressed, and most of the emitted light passes through the protecting cover 30 and is guided to the outside of the lamp device 1. Thus, the light emitted by the light-emitting module 2 can be efficiently extracted to the outside of the lamp device 1.

When the light-emitting module 2 emits light, the light-emitting diodes 8 generate heat. The heat of the light-emitting diodes 8 is conducted from the module substrate 7 to the LED attachment part 38 of the support member 5. The heat receiving surface 38*a* of the LED attachment part 38 has a shape larger than the module substrate 7 of the light-emitting module 2. Thus, the LED attachment part 38 functions as a heat spreader to diffuse the heat of the light-emitting diodes 8 over a wide range.

The heat of the light-emitting diodes 8 diffused to the LED attachment part 38 is conducted from the LED attachment part 38 through the leg part 37 to the heat receiving part 19 of the heat radiating member 4. The heat radiating member 4 is exposed to the outside of the lamp device 1 and contacts the luminaire main body of the luminaire. By this, the heat of the light-emitting diodes 8 conducted to the heat radiating member 4 is conducted from the heat radiating member 4 to the luminaire main body and is radiated from the luminaire main body to the outside of the lamp device 1.

Both the heat radiating member 4 and the support member 5 are made of metal material, such as aluminum, having excellent heat conductivity. Thus, the heat generated by the light-emitting diodes 8 is quickly released to the luminaire main body through the support member 5 and the heat radiating member 4. Further, the heat of the light-emitting diodes 8 can be actively radiated from the support member 5 and the heat radiating member 4. Thus, heat radiation property of the light-emitting diodes 8 is improved and luminous efficacy of the light-emitting diodes 8 can be excellently maintained.

The circuit board 26 of the lighting device 6 is interposed between the light-emitting module 2 and the end wall 15 of the main body 3. A center portion of the circuit board 26 faces the LED attachment part 38 to support the light-emitting module 2. In other words, an inner peripheral edge of the circuit board 26 to define the through hole 16 can be extended to an outer peripheral surface of the leg part 37 of the support member 5 passing through the through hole 16. Thus, areas of the first and the second mount surface 26*a* and 26*b* of the circuit board 26 can be sufficiently ensured. Thus, the degree of freedom in arrangement of the circuit parts 43 on the first and the second mount surfaces 26*a* and 26*b* is increased.

According to the first embodiment, the heat generated by the light-emitting diodes 8 of the light-emitting module 2 is conducted from the support member 5 to the heat radiating member 4 and can be discharged to the outside of the lamp device 1. Further, with respect to the circuit board 26 of the lighting device 6, since the areas of the first and the second mount surfaces 26*a* and 26*b* can be sufficiently ensured, the circuit parts 43 can be easily arranged at desired positions of the circuit board 26.

In addition, the light-emitting module 2 is closer to the protecting cover 30 than the end wall 15 of the main body 3. Thus, the ratio of direct radiation of the light of the light-emitting diodes 8 to the outside of the lamp device 1 from the protecting cover 30 can be increased. As a result, attenuation of the light emitted by the light-emitting diodes 8 can be suppressed, and luminous flux from the light-emitting module 2 can be used as luminous flux of the lamp device 1 without substantial loss. By this, the lamp device 1 having sufficient brightness can be obtained.

The leg part 37 of the support member 5 is inserted in the through hole 16 of the end wall 15 from the direction of the opening 14 of the main body 3. Thus, although the LED attachment part 38 exists at the first end 37*a* of the leg part 37, the through hole 16 can be made small. In other words, even if the LED attachment part 38 has a shape larger than the through hole 16, the second end 37*b* of the leg part 37 is inserted in the through hole 16, and the heat radiating member 4 can be fixed to the second end 37*b*. Accordingly, the structure for conducting the heat of the light-emitting module 2 to the heat radiating member 4 can be simplified. In addition, the operation of assembling the support member 5 to the main body 3 is facilitated, and the manufacturing cost of the lamp device 1 can be reduced.

In the light-emitting module 2 of the first embodiment, although the light-emitting diodes 8 are mounted on the module substrate 7, the module substrate 7 is not an indispensable component. For example, the light-emitting diodes 8 may be mounted on the heat receiving surface 38*a* of the LED attachment part 38 of the support member 5. When the light-emitting diodes 8 are mounted on the heat receiving surface 38*a*, the heat receiving surface 38*a* made of metal is covered with an insulating layer. By this, the light-emitting diodes 8 are mounted on the insulating layer in a state where the light-emitting diodes are electrically separated from the LED attachment part 38.

Second Embodiment

Figure 5:
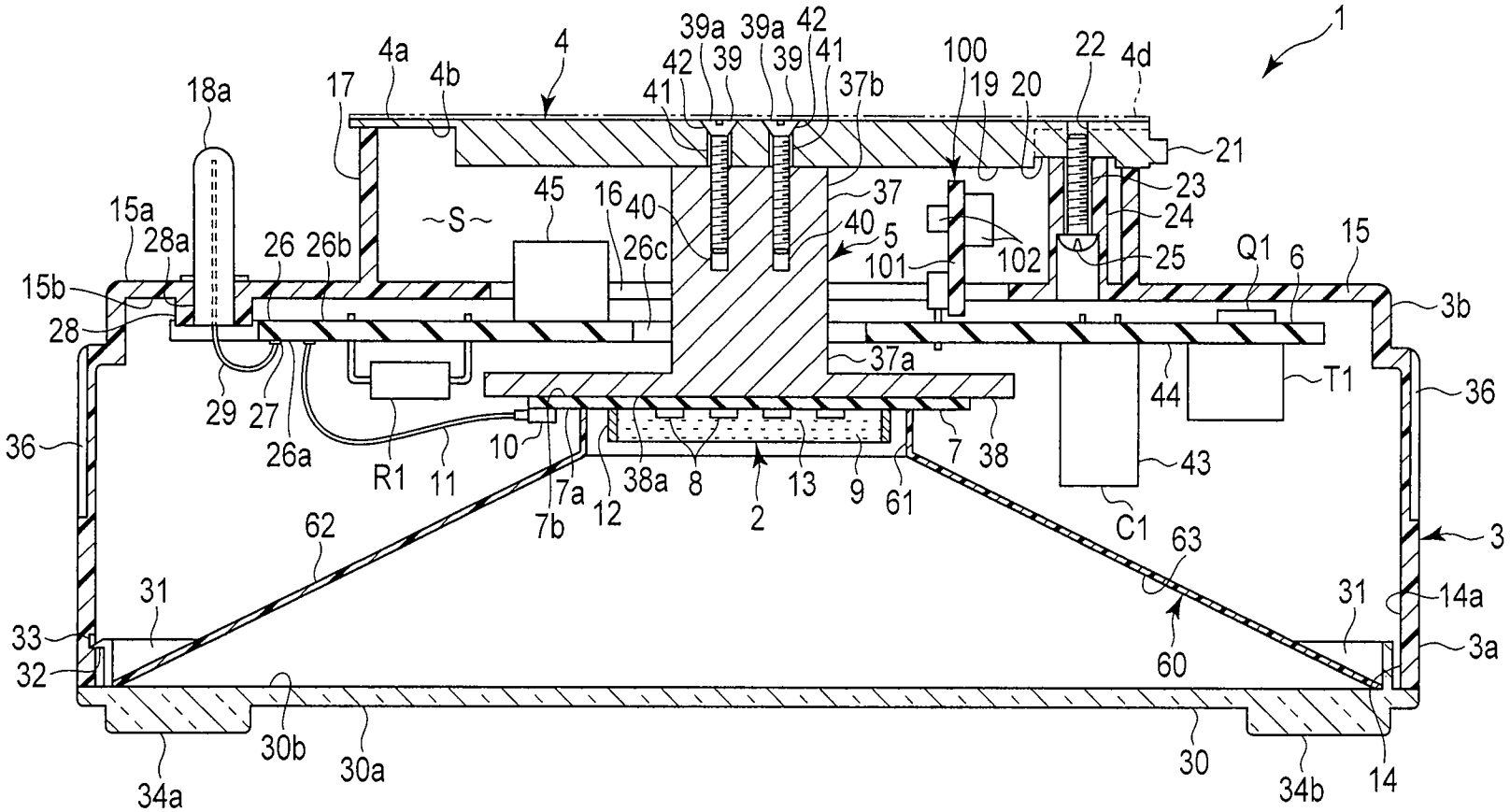
FIG. 5 is an exemplary sectional view of a lamp device of a second embodiment.

FIG. 5 shows a second embodiment. A lamp device 1 of the second embodiment includes a reflector 60 housed in a main body 3. The structure of the lamp device 1 except the reflector 60 is the same as the first embodiment. Thus, in the second embodiment, the same components as those of the first embodiment are denoted by the same reference numerals and the description thereof is omitted.

As shown in FIG. 5, the reflector 60 is a component for controlling luminous intensity distribution of the lamp device 1. The reflector 60 includes a support part 61 and a light reflecting part 62. The support part 61 is cylindrical, and is supported on a first surface 7*a* of a module substrate 7 so as to surround a frame 12 of a light-emitting module 2. The light reflecting part 62 has such a shape as to spread from one end of the support part 61 to an edge of an opening 14 of the main body 3. Thus, the light reflecting part 62 covers and conceals an outer peripheral part of the module substrate 7, an outer peripheral part of an LED attachment part 38, and a lighting device 6 from a direction of the opening 14 of the main body 3. Further, the light reflecting part 62 includes a reflecting surface 63. The reflecting surface 63 reflects light, which is directed from the light-emitting module 2 to the light reflecting part 62, to a protecting cover 30. By this, quantity of light passing through the protecting cover 30 and emitted to the outside of the lamp device 1 is increased.

According to the second embodiment, the light reflecting part 62 of the reflector 60 is interposed between a component not contributing to light emission, such as the lighting device 6 housed inside the main body 3, and the protecting cover 30. Thus, the component not contributing to the light emission is not seen through the protecting cover 30 from the outside of the lamp device 1. Thus, the appearance of the lamp device 1 becomes excellent.

In the second embodiment, although the reflector 60 is housed in the main body 3, for example, a concealing plate may be used instead of the reflector 60. The concealing plate is made to have, for example, the same shape as the reflector 60, so that the component inside the main body 3 and not contributing to the light emission can be concealed from the direction of the protecting cover 30.

Third Embodiment

Figure 6:
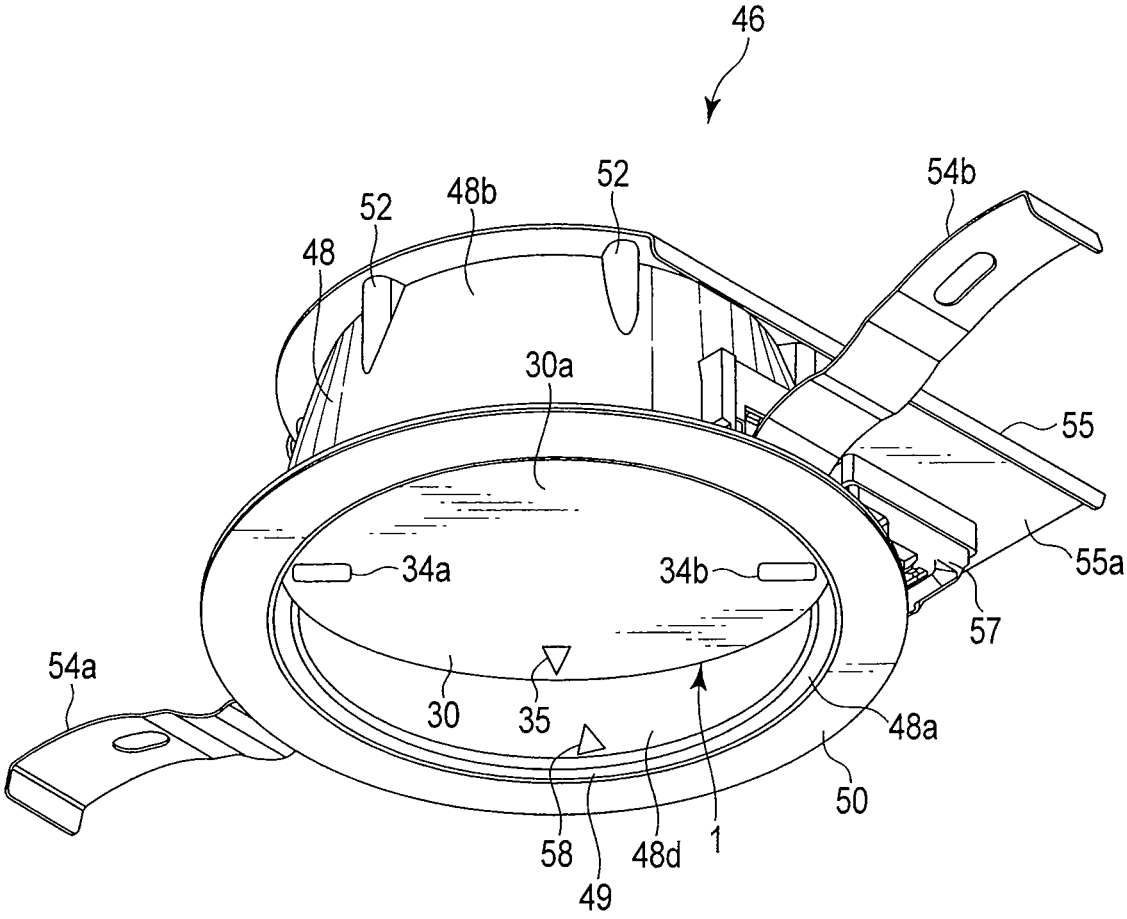
FIG. 6 is an exemplary perspective view of a luminaire of a third embodiment.
Figure 7:
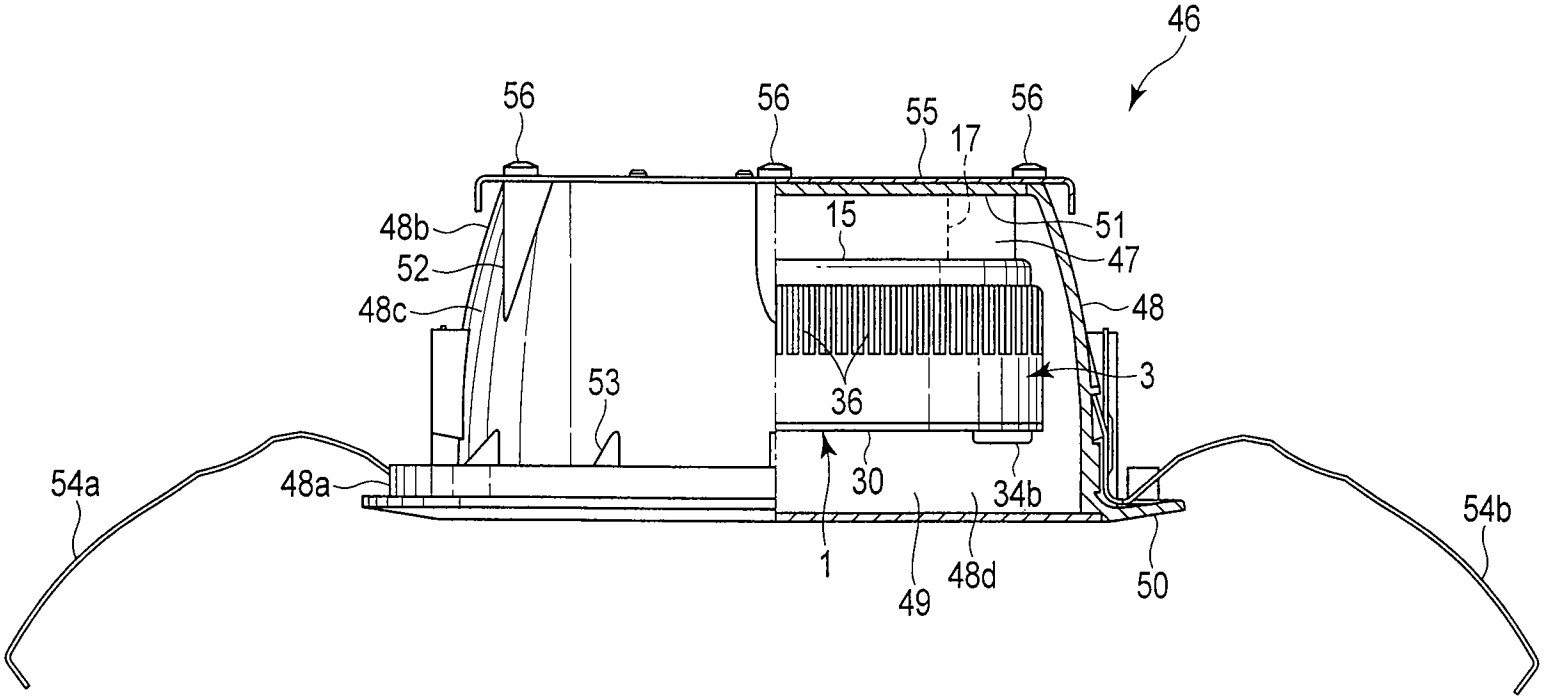
FIG. 7 is an exemplary side view showing a section of a part of the luminaire of the third embodiment.

FIG. 6 and FIG. 7 show a third embodiment. The third embodiment discloses a luminaire 46 in which the lamp device 1 described in the first embodiment or the second embodiment is used as a light source. In the third embodiment, components of the lamp device 1 are denoted by the same reference numerals as those of the lamp device 1 of the first embodiment or the second embodiment and the description thereof is omitted.

The luminaire 46 shown in FIG. 6 and FIG. 7 is, for example, a downlight embedded in a ceiling of a house. The luminaire 46 includes a socket 47 and a luminaire main body 48. The luminaire main body 48 is, for example, a die-cast part using aluminum. The luminaire main body 48 has a substantially cylindrical shape including a lower end 48*a* and an upper end 48*b*. The lower end 48*a* of the luminaire main body 48 defines a circular opening 49. An inner peripheral surface 48*d* of the luminaire main body 48 is coated with, for example, white color. Thus, the inner peripheral surface 48*d* of the luminaire main body 48 is a reflecting surface to reflect light emitted from the lamp device 1.

A flange part 50 is formed at the lower end 48*a* of the luminaire main body 48. The flange part 50 is continuous in the circumferential direction of the luminaire main body 48, and protrudes from the lower end 48*a* of the luminaire main body 48 to the outer periphery of the luminaire main body 48. The opening 49 and the flange part 50 are exposed at the ceiling.

A flat upper plate part 51 is formed integrally with the upper end 48*b* of the luminaire main body 48. The upper plate part 51 closes the upper end 48*b* of the luminaire main body 48 and faces the opening 49. Further, plural reinforcing pieces 52 are formed on an outer peripheral surface 48*c* of the luminaire main body 48. The reinforcing pieces 52 extend in the axial direction of the luminaire main body 48, and are arranged at intervals in the circumferential direction of the luminaire main body 48. According to the third embodiment, the reinforcing pieces 52 protrude radially from the outer peripheral surface 48*c* of the luminaire main body 48 and function also as heat radiating fins.

A pair of metal fittings 54*a* and 54*b* are provided at the lower end 48*a* of the luminaire main body 48. The metal fittings 54*a* and 54*b* are formed of, for example, plate springs. When the luminaire main body 48 is inserted in a mount hole opened in the ceiling, the metal fittings 54*a* and 54*b* cooperate with the flange part 50 and hold the ceiling. By this, the luminaire main body 48 is held to the ceiling in the state where the luminaire main body 48 is embedded in the ceiling.

As shown in FIG. 6, a top plate 55 is attached onto the upper plate part 51 of the luminaire main body 48 by plural screws 56. The top plate 55 includes a lower surface 55*a* separated from the luminaire main body 48. A terminal stand 57 is attached to the lower surface 55*a* of the top plate 55. A power supply line extended from an external power supply and a lead wire connected to the socket 47 are connected to the terminal stand 57. Further, a triangular guide mark 58 is formed on the inner peripheral surface 48*d* of the luminaire main body 48. The guide mark 58 is a component indicating the direction of the lamp device 1 with respect to the luminaire main body 48.

As shown in FIG. 7, the socket 47 is fixed to a lower surface of the upper plate part 51 of the luminaire main body 48 by plural screws. As the socket 47, a well-known structure in which a base of the lamp device 1 can be mounted. Specifically, the socket 47 includes a receiving part in which a protrusion 17 of a main body 3 is inserted, and plural connection holes in which power supply pins 18*a* and 18*b* and lighting control pins 18*c* and 18*d* of the lamp device 1 are respectively inserted.

The protrusion 17 of the lamp device 1 is inserted in the socket 47 from the opening 49 of the luminaire main body 48 at a position where a triangular mark 35 coincides with the guide mark 58 of the socket 47. When the main body 3 is rotated after the protrusion 17 is inserted in the socket 47, engagement parts 21 of a heat radiating member 4 are hooked in the socket, and the lamp device 1 is held by the luminaire main body 48. Further, the power supply pins 18*a* and 18*b* are electrically connected to a pair of power supply terminals provided in the connection holes. Similarly, the lighting control pins 18*c* and 18*d* are electrically connected to a pair of lighting control terminals provided in the connection holes. As a result, the lamp device 1 is electrically connected to the external power supply through the luminaire 46.

When AC voltage is applied to the terminal stand 57 of the luminaire 46 from the external power supply, light-emitting diodes 8 of the lamp device 1 simultaneously emit light. By this, white light is emitted from a light-emitting module 2 to a protecting cover 30. The white light passes through the protecting cover 30, and illuminates a floor surface from the direction of the ceiling.

According to the third embodiment, in the luminaire 46, the lamp device 1 which can efficiently extract light emitted by the light-emitting diodes 8 to the outside of the main body 3 is used as the light source. Thus, the quantity of light directed from the direction of the ceiling to the floor surface is sufficiently ensured and the floor surface can be brightly illuminated.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A lamp device comprising:

a main body including an opening, an end wall facing the opening, a protrusion protruding from the end wall to an opposite side of the opening, and a heat radiating part provided at the opposite side to the opening and positioned at an end surface of the protrusion;

a light-emitting module housed in the main body and including a light-emitting element to emit light to the opening;

a lighting device housed in the main body; and a support member that is housed in the main body, wherein the support member is thermally coupled to the light-emitting module and the heat radiating part to conduct heat generated by the light-emitting element to the heat radiating part, and holds the light-emitting module in the main body to cause the light-emitting module to be positioned closer to the opening than the lighting device.

2. The device of claim 1, wherein the support member includes a leg part thermally coupled to the heat radiating part, and an attachment part thermally coupled to the light-emitting module, and the leg part passes through the end wall and the lighting device from the heat radiating part and protrudes towards the opening of the main body.

3. The device of claim 2, wherein the attachment part of the support member is provided inside the main body and at a position closer to the opening than the lighting device.

4. The device of claim 3, wherein the end wall of the main body is provided with a through hole through which the leg part of the support member passes.

5. The device of claim 4, wherein the lighting device includes a circuit board on which a plurality of circuit parts is mounted, the circuit board is interposed between the end wall of the main body and the attachment part of the support member, and the circuit board is provided with a hole through which the leg part of the support member passes.

6. The device of claim 5, wherein the attachment part has a shape larger than the light-emitting module and the hole of the circuit board.

7. The device of claim 5, wherein the attachment part includes a flat heat receiving surface, the heat receiving surface is positioned at an opposite side to the leg part, and the light-emitting module is fixed to the heat receiving surface.

8. The device of claim 5, wherein a space provided between the heat radiating part and the circuit board is surrounded by the protrusion of the main body.

9. The device of claim 8, wherein some of the circuit parts are housed in the space.

10. The device of claim 8, wherein the lighting device includes a lighting control unit, and the lighting control unit is housed in the space.

11. The device of claim 1, further comprising a translucent cover to cover the opening of the main body.

12. A lamp device comprising:

a main body including an opening, an end wall facing the opening, and a protrusion protruding from the end wall to an opposite side of the opening;

a heat radiating member that is fixed to the main body, is positioned at an end surface of the protrusion, is exposed to an outside of the main body at the opposite side of the opening, and includes a support part positioned in the main body;

a light-emitting module that is supported by the support part, includes a light-emitting element to emit light to the opening, and is thermally coupled to the heat radiating member through the support part; and a lighting device that is housed in the main body and is positioned between the heat radiating member and the light-emitting module.

13. The device of claim 12, wherein the support part includes a leg part thermally coupled to the heat radiating member, and an attachment part thermally coupled to the light-emitting module, and the leg part passes through the end wall and the lighting device from the heat radiating member and protrudes to the opening of the main body.

14. The device of claim 12, wherein the lighting device includes a circuit board on which a plurality of circuit parts are mounted, the circuit board is interposed between the end wall of the main body and the attachment part of the support part, and the circuit board is provided with a hole through which the leg part of the support part passes.

* * * * *